United States Patent [19]

Schaper

[11] 4,409,031

[45] Oct. 11, 1983

[54] CONTINUOUSLY OPERABLE SUGAR CENTRIFUGAL AND METHOD FOR IMPROVING THE PURITY OF THE PRODUCED SUGAR

[75] Inventor: Helmut Schaper, Brunswick, Fed. Rep. of Germany

[73] Assignee: Braunschweigische Maschinenbauanstalt AG, Brunswick, Fed. Rep. of Germany

[21] Appl. No.: 348,680

[22] Filed: Feb. 16, 1982

[30] Foreign Application Priority Data

Feb. 24, 1981 [DE] Fed. Rep. of Germany ..... 3106739

[51] Int. Cl.[3] ..... C13F 1/06; C13F 1/10

[52] U.S. Cl. ..... 127/19; 210/369

[58] Field of Search ..... 127/19; 233/28, 34, 233/45; 210/297, 360.2, 371, 377, 380.1

[56] References Cited

U.S. PATENT DOCUMENTS

| | | | |
|---|---|---|---|
| 4,063,959 | 12/1977 | Dietzel et al. | 127/19 |
| 4,131,482 | 12/1978 | Dietzel | 127/19 |
| 4,331,482 | 5/1982 | Schaper | 127/19 |

*Primary Examiner*—Ferris H. Lander

*Attorney, Agent, or Firm*—W. G. Fasse; D. H. Kane, Jr.

[57] ABSTRACT

Continuously operable sugar centrifugals can achieve degrees of sugar purities comparable to those achieved by batch centrifugals if the diameter of the drying stage following the washing stage flares out in steps and/or extends at an opposed angle. Further, the inside of the drying stage is provided with a cover which, together with the upper drop edge of the washing stage, forms such a narrow passage or gap that the mist of contaminated wash liquid developing in the washing stage is kept away from the sugar in the drying stage. Thus, these mists of contaminated wash liquid may be discharged separately from the sugar.

6 Claims, 12 Drawing Figures

Fig. 5
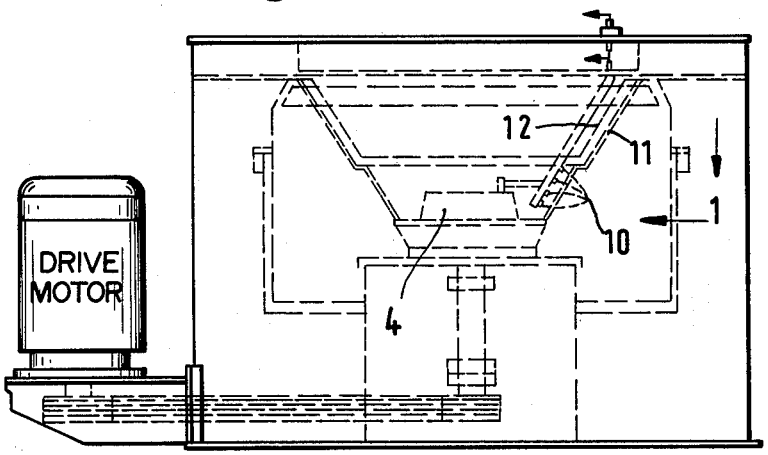
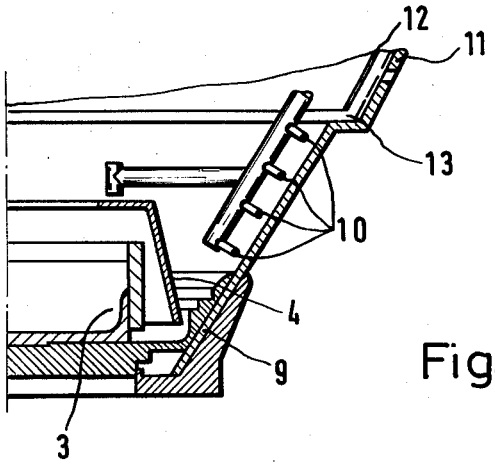
Fig. 6

Fig.10
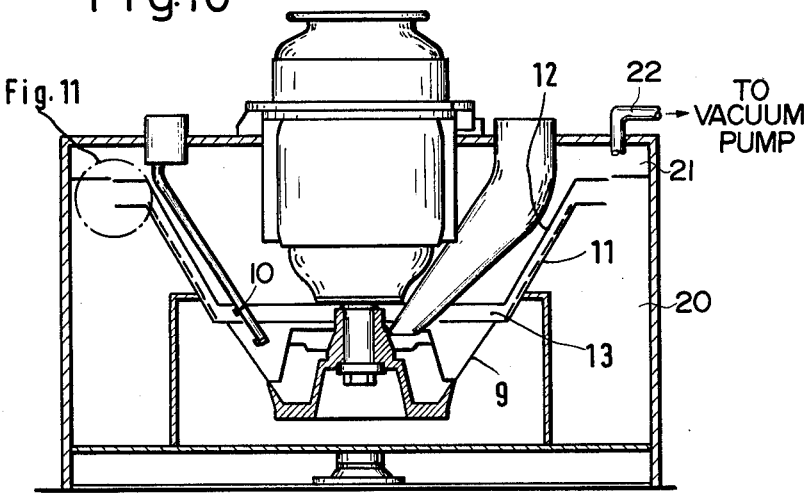
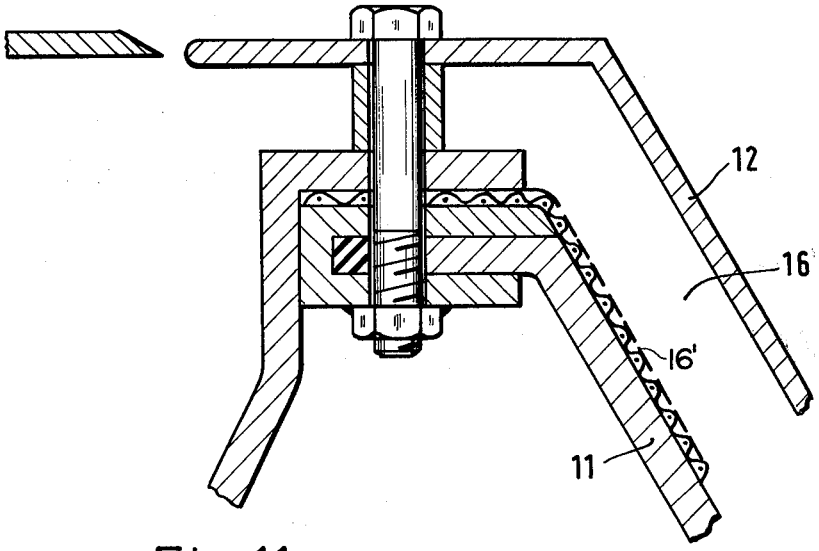
Fig.11

CONTINUOUSLY OPERABLE SUGAR CENTRIFUGAL AND METHOD FOR IMPROVING THE PURITY OF THE PRODUCED SUGAR

CROSS-REFERENCE TO RELATED APPLICATION

The present application corresponds to German Patent Application P No. 31 06 739, filed in the Federal Republic of Germany on Feb. 24, 1981. The priority of said German filing date is claimed for the present application.

BACKGROUND OF THE INVENTION

The present invention relates to a continuously operable sugar centrifugal. More specifically the invention relates to a method of improving the purity of sugar produced by continuously operable sugar centrifugals.

Continuously operable sugar centrifugals have been employed for a long time heretofore. Due to their comparatively simple construction, and in particular their specifically energy saving operation, they are highly superior to batch centrifugals. Heretofore, however, the sugar industry has not been able to do without batch centrifugals, especially when sugar of a high purity is to be produced, or when by just one centrifuging operation the purity of the sugar shall be improved to a large degree.

It has been known for a long time that the sugar-technological phenomena in washing are responsible for the reduced purity of sugar produced by continuously operating centrifugals. It was assumed that in a batch centrifugal the washing effect is enhanced by the fact that, compared to a continuously operating centrifugal, the sugar is washed in a comparatively thick and dense layer. The intensity and the time of contact between the wash liquid and the sugar crystals were thus thought to be optimal. Following this assumption, so-called continuously operating thick-layer flow centrifugals were developed. But the result was disappointing. A substantial increase in sugar purity could not be achieved. Then tests were made by accumulating the sugar in these so-called continuous centrifugals so as to provide dense crystal packing conditions for the washing similar to those in batch centrifugals. But again, the sugar purity could not be improved to such a degree that it could be compared to the purity of sugar produced in batch centrifugals.

At a much earlier stage of development efforts had been made to increase the application of wash liquid in continuous centrifugals. But this measure met with the sugar industry's objection just because this increased the quantity of runoff to be re-processed, especially by energy-consuming re-evaporation. Besides, the results were suprisingly negative, since this measure could not considerably improve the purity of the sugar. Instead, the increasing quantity of wash liquid went along with increasing sugar losses resulting from partial dissolution of sugar crystals.

In the centrifugal according to German Pat. No. 65,118 the upper part of the conically shaped basket is covered by an apron made of resilient material. This apron rotates with the basket. The apron is intended to bring the wash liquid into a more intimate contact with the medium to be centrifuged. As a result, the contaminated wash liquid mist is applied again to the medium. A shielding effect as provided by the invention has neither been intended nor realized in this reference.

Though German Patent Application No. 2,447,175 reveals the realization that any wash liquid mist entrained outside of the washing zone is detrimental to the sugar, because it carries moisture into those areas where the sugar shall become or remain dry, it does not reveal the essential realization that the entrained wash liquid mist is responsible for the comparatively low increase in the purity of sugar produced in a continuously operating centrifugal. Moreover, this prior art offers an unpractical and technologically disadvantageous solution to the problem of a continuous high purity sugar production, since it suggests to seal the washing zone as a chamber from the other inner space of the centrifugal, especially the inner space of the basket. Such sealing can be accomplished only if suitable sealing elements rest at a sufficiently high pressure on the sugar layer moving across the inner surface of the basket or its separating screen. Such measures impair an unobstructed flow of the sugar. As the sugar layer never has a sufficiently uniform thickness, this produces either non-dense spots or undesired obstacles to the flow of the sugar. Not the least problems are caused by the necessary sealing elements because they are subject to heavy wear by the sugar passing under them. Further, sugar crystals are damaged by abrasion at the same time. Therefore, this prior art has substantial disadvantages in actual operation. In a chamber-like sealing of the washing zone, contaminated wash liquid mist is forced back to the sugar, the sugar is again contaminated. The fractions of a second or the few seconds the sugar takes to pass through the washing or drying zone or through the entire machine are too short a time to eliminate this re-contamination of the drying sugar.

OBJECTS OF THE INVENTION

In view of the above it is the aim of the invention to achieve the following objects singly or in combination:

- to improve a continuously operating sugar centrifuge so that the purity of its sugar output is comparable to that of batch type centrifugals;
- to effectively separate the washing operaton or function in a continuously operating sugar centrifugal from the drying operation or function thereof;
- to avoid any or substantially any recontamination of the sugar in the drying stage of the centrifugal;
- to provide a method and apparatus for producing on a continuous basis, improved sugar purities, as compared to the purity of batch-wise produced sugar;
- to provide a method for continuously producing sugar of improved purity, which method may be implemented by means of conventional, continuously operating sugar centrifugals which are modified as taught herein; and
- to separately remove contaminated wash liquid mists from a continuously operating sugar centrifugal before such mists can adversely affect the purity of the sugar being produced.

SUMMARY OF THE INVENTION

The invention is based on the realization that in the centrifuging of sugar in centrifugal machines it is essential to effectively separate the washing from the drying in order to obtain a large increase in the sugar purity. In other words, according to the invention the contaminated wash liquid or wash liquid mists must be kept away from the drying sugar and discharged separately. In batch centrifugals this separation is ensured by the sequential performance of the two processes. In continuous centrifugals this sequential performance of washing and drying is replaced by a temporal, but not spatial, coincidence. Due to the construction of continuous centrifugals, the sugar has to pass the frustum-shaped basket from the small-diameter zone towards the large-diameter zone. Since washing takes place before drying, the washing zone of continuous centrifugals is located upstream of the drying zone as viewed in the flow direction, i.e. in basket areas having a smaller diameter than the drying zone. The conical shape of the baskets of continuous centrifugals produces, besides heavy air turbulences, quite a violent air current which is directed across the sugar surface from the narrow diameter end to the wide diameter end of the basket. This air current is the reason why the spatial non-coincidence of the washing and drying operations in a continuously operable sugar centrifugal does not produce the same effect as the temporal non-coincidence of these operations in a batch centrifugal.

During the washing operation a considerable portion of the wash liquid hitting the sugar layer is atomized mechanically and rebounds whereby the contaminations dissolved by the wash liquid from the crystal surfaces are atomized and the resulting mist is also thrown back. In continuous centrifugals this contaminated wash liquid mist is caught by the violent air current and carried to the drying zone where it again contaminates the sugar. The extremely short time retention of the sugar in the individual zones of the basket does not suffice to prevent such re-contamination.

The fundamental idea of the invention, therefore, is to prevent the re-contamination of the sugar in the drying zone by effectively shielding the sugar in the drying zone from the entrained mist of contaminated wash liquid. More specifically, this shielding effect is produced by the cover and the very narrow sugar passage, while the separate receiving and discharging device for the wash liquid mist, for the condensate and for sugar lumps prevents the contaminated wash liquid mist from entering the sugar receiving compartment of the centrifugal. Theoretically or ideally the sugar passage gap according to the invention should be narrow that, apart from sugar, no air which might entrain any contaminated wash liquid mist can enter the space under the cover. In actual practice, however, this ideal can be realized only approximately. In order to get as close as possible to this ideal, the narrow end of the cover rests on the washing stage by web-shaped supports shaped to operate as fan blades and the width of the sugar passage gap is adjustable. Both of these features help approach the ideal solution. The supports shaped as fan blades intensify the air current across the inner basket surface and counteract its being deflected toward and through the sugar passage. The variability of the sugar passage gap width allows this passage to be adjusted as narrow as ever possible under any prevailing operating conditions.

The centrifugal according to the invention gave satisfactory test results. The purity of the sugar produced differed negligibly from that of sugar produced in batch centrifugals. As far as its purity was concerned, this sugar could be put in the same quality class as sugar from batch centrifugals. Thus it has been possible for the first time to increase the purity of sugar produced in continuous centrifugals which can be compared to the purity obtained in batch centrifugals. This is considered to be a surprising result in the light of all the prior art efforts to improve the purity of sugar produced by continuously operating sugar centrifugals.

The realization underlying the invention must be correct, because tests revealed that the separate receiving and discharging device for wash liquid mist, condensate and sugar lumps discharged a liquid very dark in color. In known centrifugals this heavily contaminated liquid deteriorates the sugar in the drying zone. The teaching of the invention can be applied, with the same success, to all known continuously operable sugar centrifugals with frustum-shaped baskets being on the market or in operation.

BRIEF FIGURE DESCRIPTION

In order that the invention may be clearly understood, it will now be described, by way of example, with reference to the accompanying drawings, wherein:

FIG. 5 shows the invention embodied in a conventional continuous centrifugal with a bottom supported basket;

FIG. 6 shows an enlarged sectional view through the lower right portion of the basket of FIG. 5;

FIG. 10 shows an embodiment in which the collection zone for contaminated wash water mists, condensate and sugar lumps is connected to a source of reduced pressure;

FIG. 11 shows a construction detail in section and on an enlarged scale compared to the respective dash-dotted circle in FIG. 10.

DETAILED DESCRIPTION OF PREFERRED EXAMPLE EMBODIMENTS AND OF THE BEST MODE OF THE INVENTION

Figure 1:
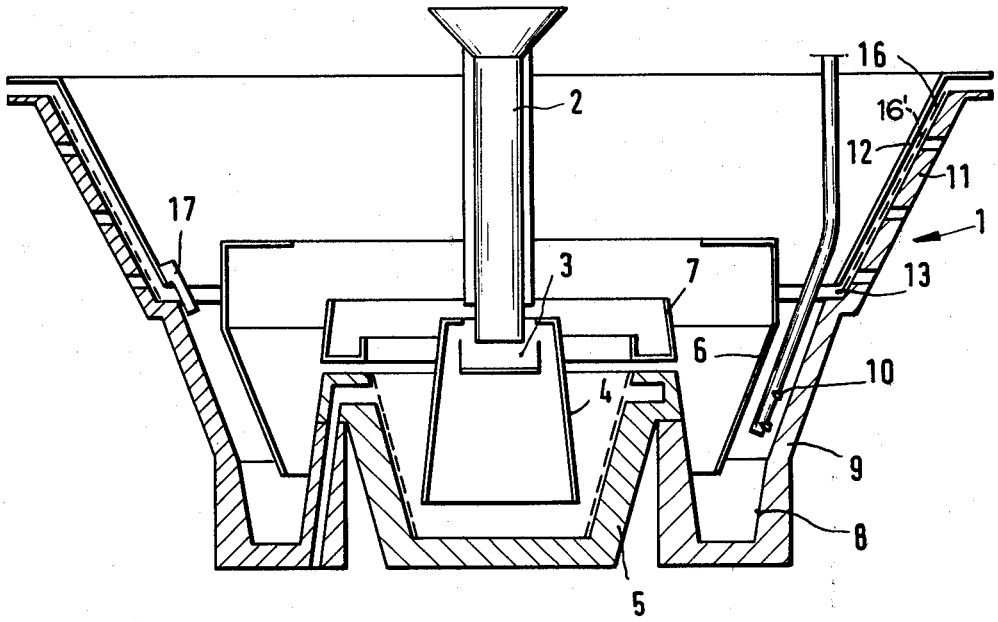
FIG. 1 is a sectional diagrammatic view of one embodiment of a sugar centrifugal according to the invention, whereby portions unimportant to the understanding of the invention have been omitted.

FIG. 1 shows a multi-stage continuously operable sugar centrifugal 1 comprising a massecuite feeding device 2, an accelerating cup 3 and an accelerating bell 4. The medium to be centrifuged coming from the accelerating bell 4 enters an upwardly flared frustom-shaped screened preseparating stage 5.

From the preseparating stage 5 the precentrifuged sugar is thrown against a downwardly and inwardly sloping stationary mixing ring 6 and kneaded with a suitable mixing liquid which is supplied by a distributor ring 7 rotating with the preseparating stage 5 to form a new homogeneous massecuite.

This new massecuite drops under its own gravity from the mixing ring 6 into an accelerating and separating stage 8.

Figure 2:
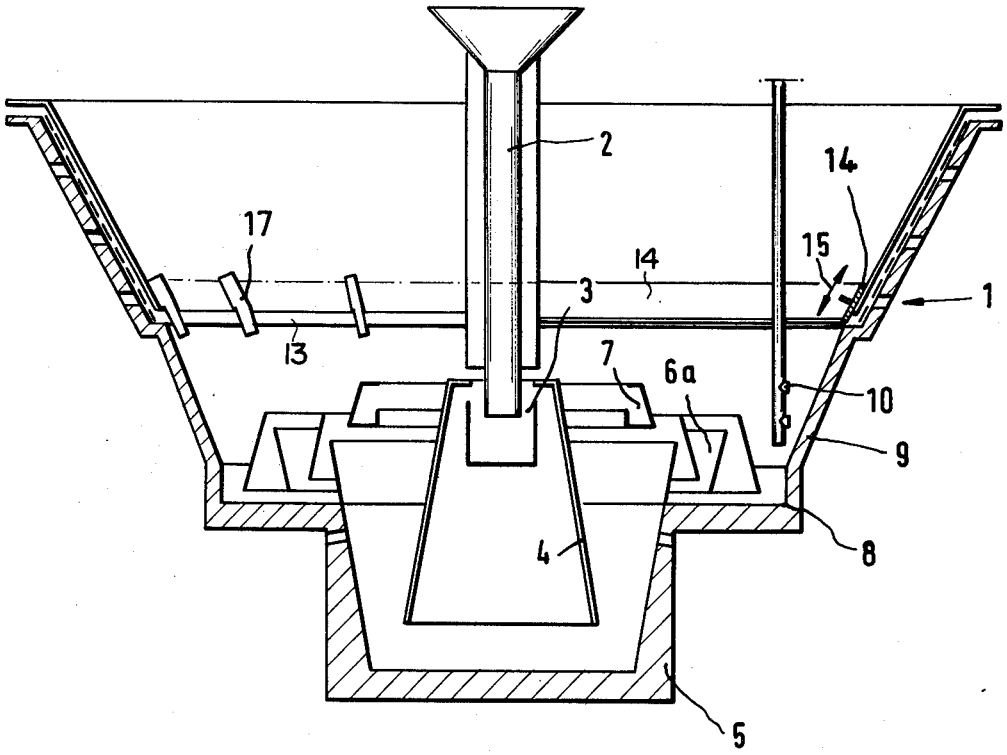
FIG. 2 shows a view similar to that of FIG. 1, of a modification with an adjustable sugar passage gap width.

The separating stage 8 is followed by a washing stage 9 which slopes outwardly more than the separating stage 8. Wash liquid is sprayed onto the sugar through stationary washing nozzles 10 reaching into the washing stage 9. In this washing stage 9 rebounding droplets of wash liquid, which had already been in contact with the sugar and therefore contain parts of the contaminations clinging to the crystal surfaces, produce a mist of contaminated wash liquid which according to the invention must be prevented from again contacting the sugar. For this purpose, the inside of the adjacent drying stage 11 is provided with a cover 12. Additionally, the diameter of the drying stage 11 is increased radially outwardly in a stepwise manner. In this embodiment the bottom edge of the cover 12 is substantially in alignment with a generating line of the inside surface of the washing stage 9. In order to get into the drying stage 11, the sugar drops from the top edge of the washing stage 9 and must pass through a slot 13 between the top or upper edge of the washing stage 9 and the bottom or lower edge of the cover 12. This slot 13 is made as narrow as ever possible; at least it is narrower than any opening through which the sugar must pass subsequently within the centrifugal. In order that the slot 13 may be conformed in an optimal manner to the prevailing operating conditions the embodiment according to FIG. 2 provides an adjustable ring 14 located at the bottom edge of the cover 12. The ring 14 is manually movable in the direction of the arrows 15 for adjusting the width of the gap 13.

The closed surface cover 12 separates the mist of contaminated wash liquid coming from the washing stage 9 and the sugar which, after passing through slot 13 is protected by said cover 12 as it travels through a space 16 between the closed surface cover 12 and a screen 16' forming part of the drying stage 11. Then the sugar travels over the upper basket edge and drops into a conventional sugar collecting chamber 20, see FIG. 3. The contaminated wash liquid mist, wash liquid condensate and even sugar lumps too big to pass through the slot 13 move up on the cover 12 and are discharged from the centrifugal into a space 21 in the centrifuge housing. The space 21 is carefully sealed from the sugar in the usual known manner, please see FIG. 10. The space 21 is connected to further discharge means such as a suction pipe 22 connected to a vacuum pump not shown.

Air flows through the space 16 between the cover 12 and the sugar in the drying stage 11. To prevent parts of contaminated wash liquid mist from getting into this space 16 and thus to the sugar, the slot 13 is as narrow as possible. Moreover, supports 17 by means of which the cover 12 rests on the washing stage 9 may be constructed as fan blades, which in the area of slot 13 produce a sufficiently strong air current directing the contaminated wash liquid mist past the slot 13.

In the embodiment according to FIG. 2, identical components are designated by the same reference numbers as in FIG. 1. In FIG. 2 the sugar centrifugal 1 is provided, instead with the stationary mixing ring 6, with a system of opposingly inclined rings **6*a*** serving as a mixing means.

Incidentally, in FIG. 2 the supports 17 may extend through slots in the adjustable ring 14 for varying the width of the gap 13.

Figure 3:
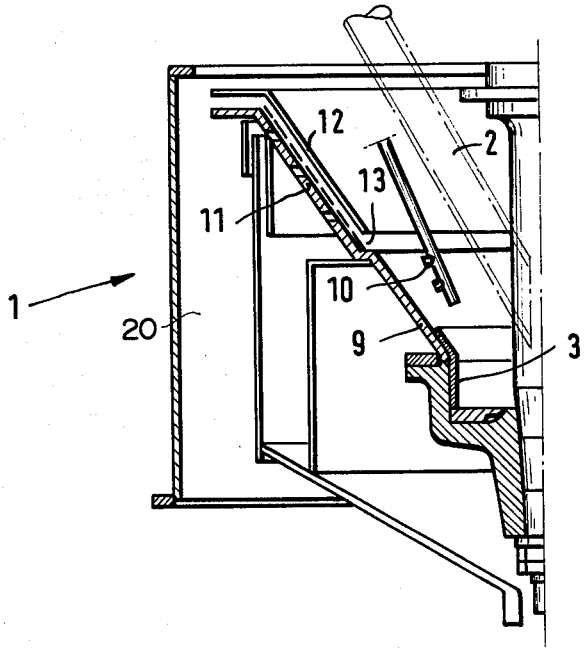
FIG. 3 shows the invention embodied in a centrifugal with a suspended centrifugal basket.

The embodiment according to FIG. 3 relates to a comparatively simple continuously operable sugar centrifugal 1 having a suspended centrifugal basket. Again, identical components are designated by the same reference numbers as in FIGS. 1 and 2.

Figure 4:
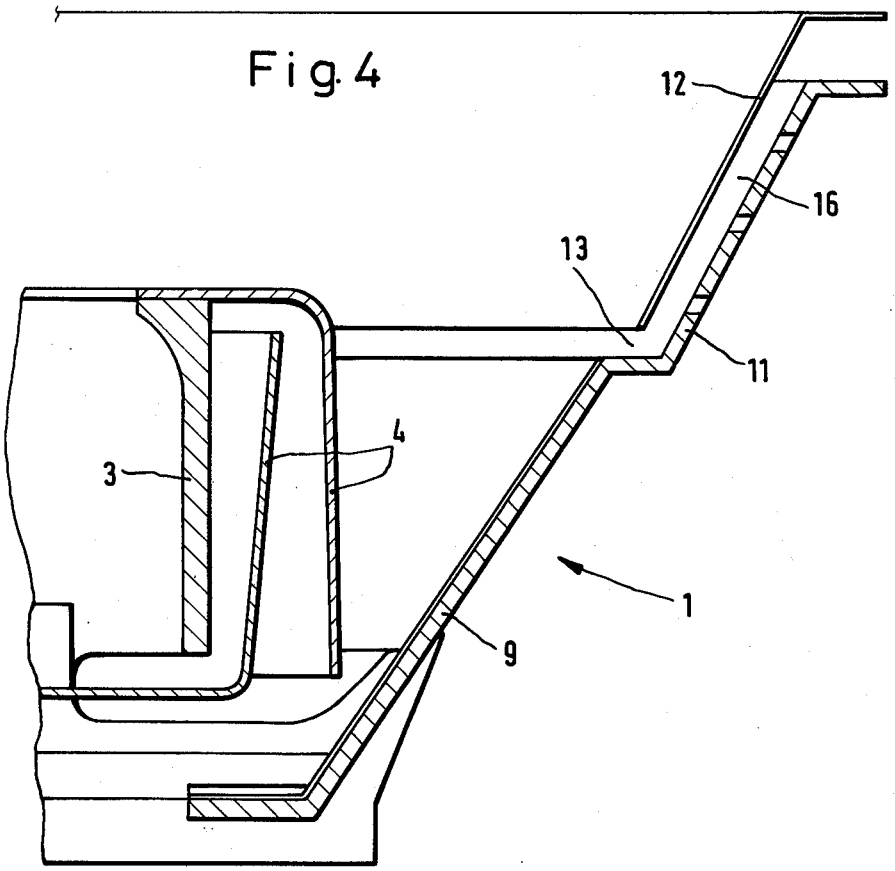
FIG. 4 shows a conventional continuously operable centrifugal of simple construction modified with the features of the invention.

FIG. 4 shows a continuously operable sugar centrifugal comprising the features of the invention, where the accelerating cup 3 and the accelerating bell 4 differ from those according to FIGS. 1 and 2.

Just as in the embodiment according to FIG. 3, the sugar centrifugal 1 according to FIG. 4 does not have a preseparating and a mixing stage, but the cover 12 and gap 13 of the invention are provided as described, except that in FIG. 4 the cover 12 is slightly displaced radially outwardly relative to a generating line of the inner surface of the washing stage 9.

FIGS. 5 and 6 show how the features of the invention may be realized in practice in another known centrifugal 1 in which the basket is conventionally supported on a vertical drive shaft.

Figure 7:
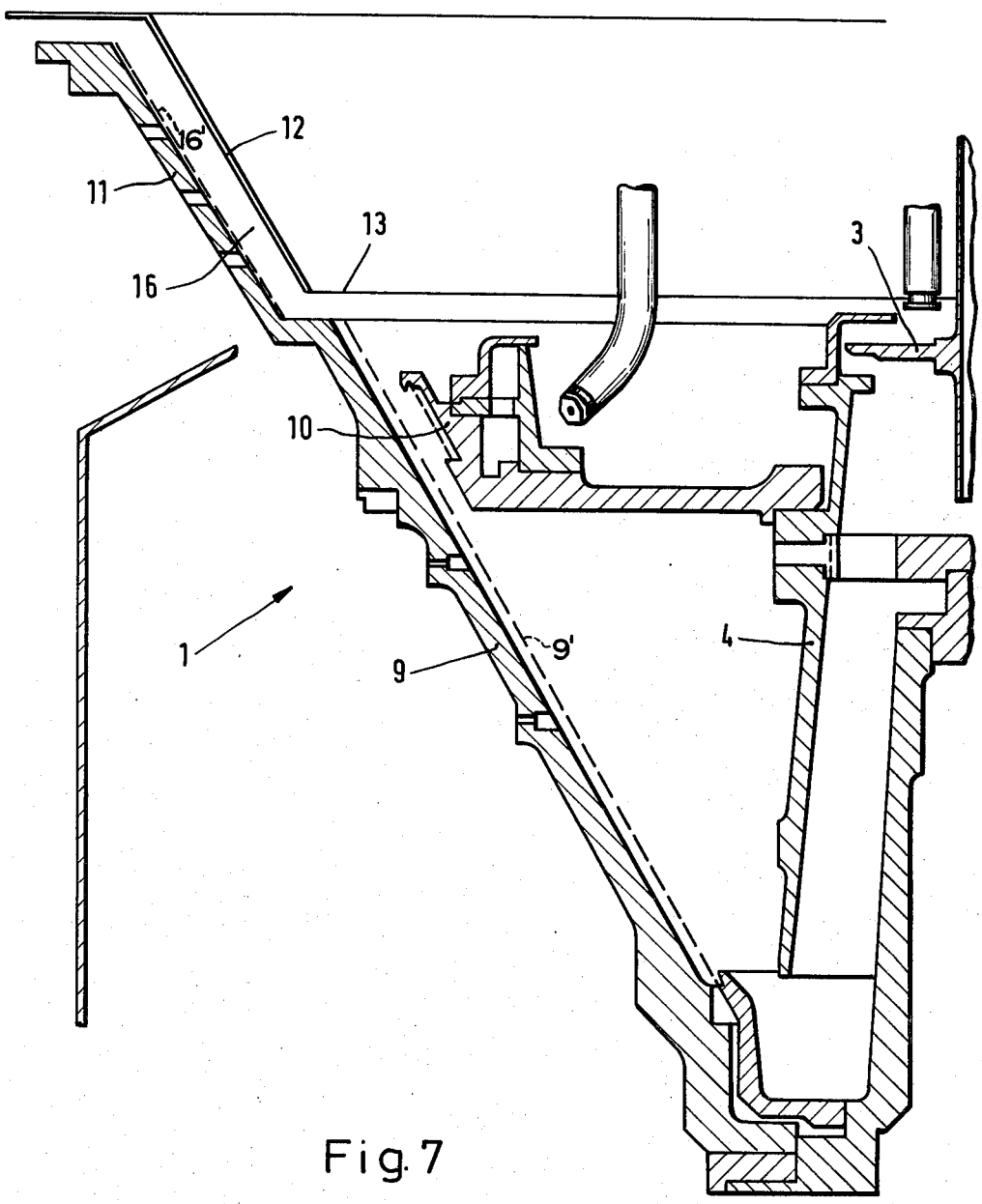
FIGS. 7, 8 & 9 show several modifications of the wash water supply in conventional centrifugals embodying the invention.

In the known centrifugal 1 according to FIG. 7 the chamber-like seal of the washing device 10 originally provided by the manufacturer has to be omitted in order that the features of the invention can be effectively implemented as shown. The washing stage 9 carries a washscreen 9' of conventional construction.

Figure 8:
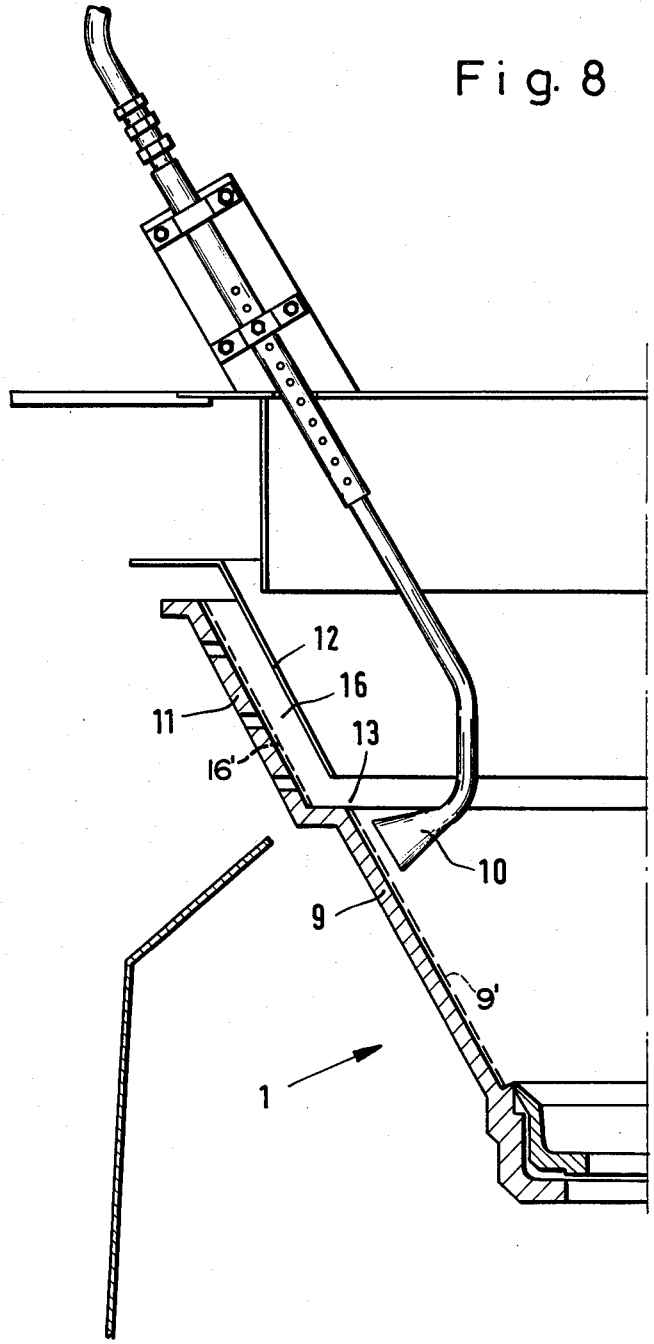

FIG. 8 shows another simple centrifugal available on the market, which has been provided with the features of the invention.

Figure 9:
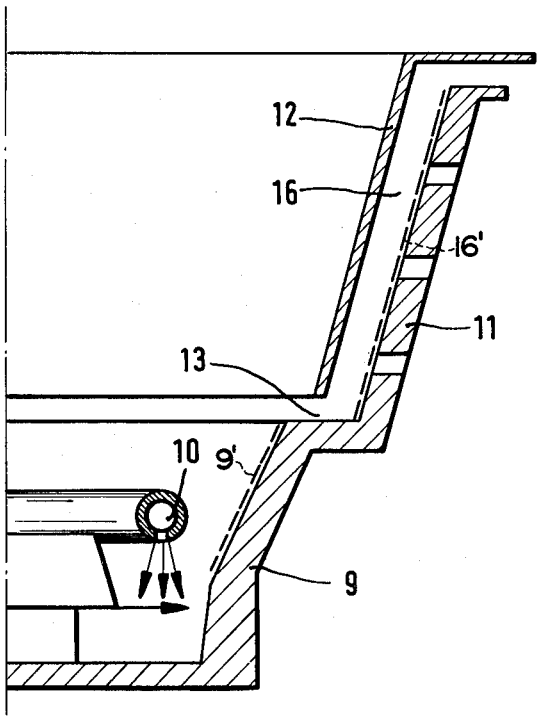

FIG. 9 shows another centrifugal, the washing device 10 of which acts toward the bottom of the basket. The features of the invention are shown in an embodiment in which the closed surface cover 12 is slightly displaced radially outwardly relative to the washing stage 9.

FIGS. 10 and 11 show a further centrifugal embodying the features of the invention whereby certain details have been described above.

Figure 12:
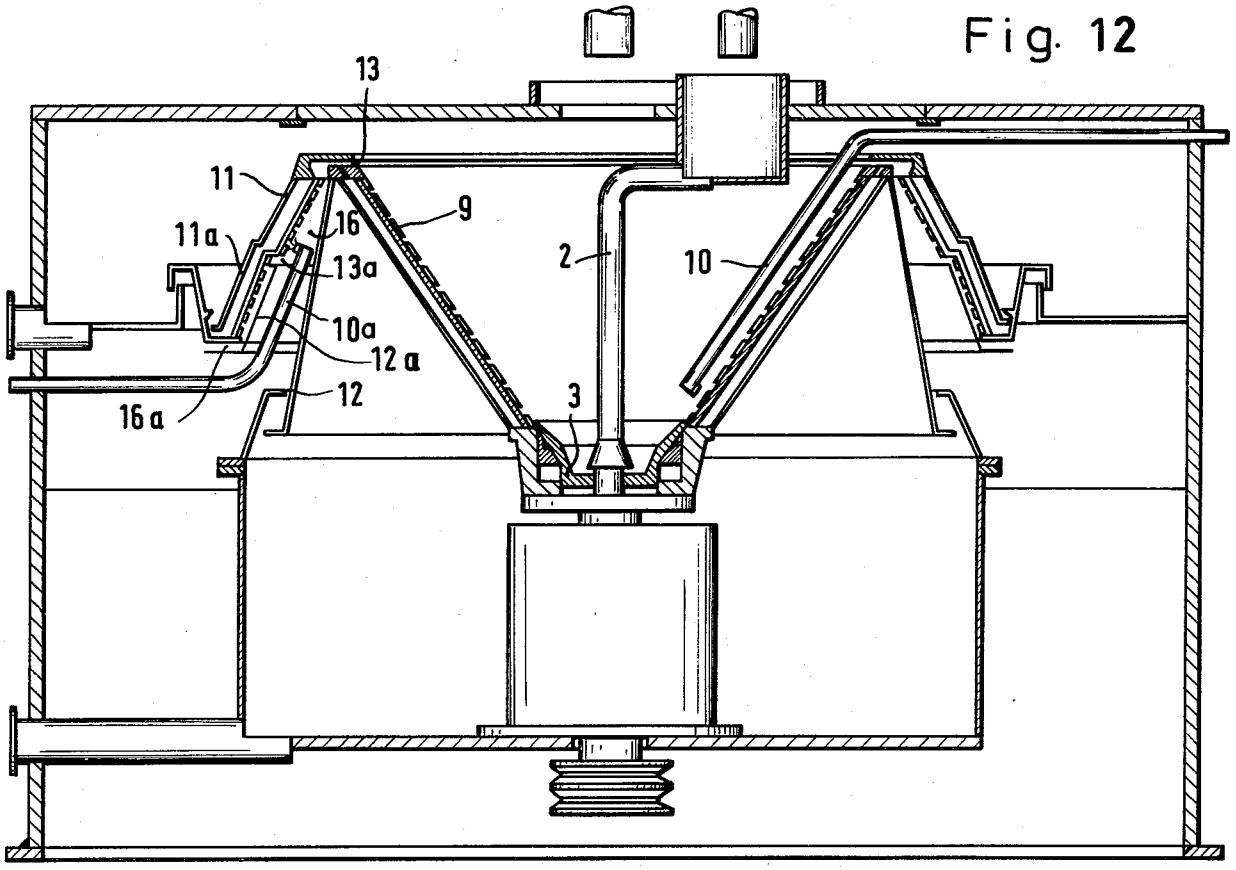
FIG. 12 embodies the invention twice in a tandem type arrangement in a single continuous centrifugal.

FIG. 12 shows another conventional centrifugal wherein the basket stages are inclined in opposed directions. Thus, it is possible to provide the features of the invention twice in order to produce extremely pure sugar. Thus, there are two drying stages 11, **11*a*, two covers 12, 12*a*, two gaps 13, 13*a*, and two spaces 16, 16*a***, all operating as described above.

The practical examples and embodiments of the invention as outlined above do not cover all of the centrifugals on the market or in operation. They indicate, however, that the invention can be applied generally to conventional centrifugals to achieve the desired results. Even centrifugals with a horizontal axis of rotation can be improved in accordance with the invention.

Although the invention has been described with reference to specific example embodiments, it will be understood, that it is intended to cover all modifications and equivalents within the scope of the appended claims.

What is claimed is:

1. A continuously operable sugar centrifugal having a rotational axis, comprising massecuite feeding means (2), massecuite distributing and accelerating means (4), a rotatably supported upwardly flaring frustum-shaped centrifugal basket including on its inside a separating screen (16'), said centrifugal basket further comprising a washing stage (9) in a narrow diameter basket area and a drying stage (11) in a larger diameter basket area, said massecuite feeding means being adapted for supplying massecuite into said centrifugal basket, stationarily arranged wash liquid supply nozzles (10) positioned for supplying washing liquid into said washing stage, separate receiving and discharging means for sugar and syrup respectively, said drying stage (11) forming, due to its larger diameter, a radially extending step which separates the drying stage (11) from said washing stage (9), closed surface cover means (12) arranged to cover the inside of said drying stage (11) and to rotate with said centrifugal basket, said closed surface cover means (12) being spaced from the separating screen (16') of the drying stage (11) to form a spacing (16), said closed surface cover means (12) having a shape substantially conforming to the shape of said centrifugal basket, said closed surface cover means (12) having a smaller diameter lower edge, said washing stage (9) having an upper sugar overflow edge adjacent to said radially extending step, said edges forming a sugar slot (13) having a width which is narrower than that of any following sugar discharge opening within the centrifugal, for causing sugar crystals to move from said washing stage substantially radially relative to said rotational axis through said sugar slot (13) and into said spacing (16) for preventing any contaminated wash liquid and wash liquid spray from contacting sugar crystals after having passed through said sugar slot into said spacing (16), said centrifugal comprising further receiving and discharging means, said closed surface cover means (12) being in communication with said further receiving and discharging means for receiving and discharging wash water mist, condensate and sugar lumps into said further receiving means.

2. The centrifugal of claim 1, wherein said smaller diameter lower edge of the cover means (12) comprises web-shaped supports (17) resting on said washing stage (9), said web-shaped supports (17) simultaneously being constructed for operating as fan blades.

3. The centrifugal of claim 1 or 2, further comprising ring means (14) adjustably secured to the smaller diameter lower edge of said cover means (12) whereby the width of the sugar slot (13) may be adjusted.

4. The centrifugal of claim 1 or 2, wherein said smaller diameter lower edge of said cover means (12) is arranged in alignment with a generating line of an inner surface of the washing stage (9).

5. The centrifugal of claim 1 or 2, wherein said smaller diameter lower edge of said cover means (12) is arranged slightly radially outwardly displaced relative to a generating line of an inner surface of the washing stage (9).

6. The centrifugal of claim 1 or 2, further comprising air vacuum generating means and wherein said further discharging means for wash water mist, condensate and sugar lumps is arranged in communication with said air vacuum generating means.

* * * * *